US005605499A

United States Patent [19]

Sugiyama et al.

[11] Patent Number: 5,605,499

[45] Date of Patent: Feb. 25, 1997

[54] FLATTENING METHOD AND FLATTENING APPARATUS OF A SEMICONDUCTOR DEVICE

[75] Inventors: Misuo Sugiyama; Hatsuyuki Arai, both of Ayase, Japan

[73] Assignee: Speedfam Company Limited, Tokyo, Japan

[21] Appl. No.: 421,706

[22] Filed: Apr. 13, 1995

[30] Foreign Application Priority Data

Apr. 27, 1994 [JP] Japan ..... 6-112091

[51] Int. Cl.[6] ..... B24B 21/18

[52] U.S. Cl. ..... 451/443; 451/41

[58] Field of Search ..... 451/41, 42, 443, 451/444, 72, 561

[56] References Cited

U.S. PATENT DOCUMENTS

| | | | |
|---|---|---|---|
| 3,568,377 | 3/1971 | Blohm et al. | 451/444 |
| 3,594,963 | 7/1971 | Beasley | 451/42 |
| 3,710,517 | 1/1973 | Valerio et al. | 451/42 |
| 3,785,094 | 1/1974 | Holzhauer | 451/532 |
| 5,154,021 | 10/1992 | Bombadier et al. | 451/444 |
| 5,172,681 | 12/1992 | Ruark et al. | 451/443 |
| 5,235,959 | 8/1993 | Frank et al. | 451/443 |

FOREIGN PATENT DOCUMENTS

| | | | |
|---|---|---|---|
| 4-35870 | 2/1992 | Japan | 451/444 |

OTHER PUBLICATIONS

Semiconductor International, Mar. 1992, pp. 44–48, Peter H. Singer, Senior Editor.

Spin–On Glass for Dielectric Planarization By Satish K. Gupta Distributedd through the courtesy of Allied–Signal Inc., Milpitas, CA.

Solid State Technology May 1992, Sematech Inc., Austin, Texas Planarizing Interlevel Dielectrics by Chemical–Mechanical Polishing.

Electronics Materials, Mar. 1994, pp. 91–96.

Speedfam CMP–V Planarization System, The Competitive Edge. 0.35, Micron Line Width Design Rule.

*Primary Examiner*—Bruce M. Kisliuk
*Assistant Examiner*—Andrew Weinberg
*Attorney, Agent, or Firm*—Kanesaka & Takeuchi

[57] ABSTRACT

A method for flattening an inter-layer insulating film of a semiconductor device of a multi-wiring is carried out with a chemical-mechanical polishing process by using an apparatus, which includes two-layer polishing cloth having an unwoven cloth and a hard foamed layer affixed on a support plate. In order to fluff on a surface of the hard foamed layer or recreate on the whole surface thereof, a tool is provided on the polishing cloth. A silicon wafer is held through a backing pad so that an insulating film of a semiconductor device formed on the wafer is polished by the polishing cloth by rotation of the support plate and the wafer, and at the same time the surface layer of the polishing cloth is fluffed by the tool provided with a polishing surface having the curvature as that of the backing pad. Therefore, a polishing rate can be kept stable, and uniformity of polishing quantity is improved.

21 Claims, 12 Drawing Sheets

Wafer 6 inch φ,
(r ≒ 280 mm, Flatness 4 μ Incase of d = 4 + 8 μ)

Fig. 7
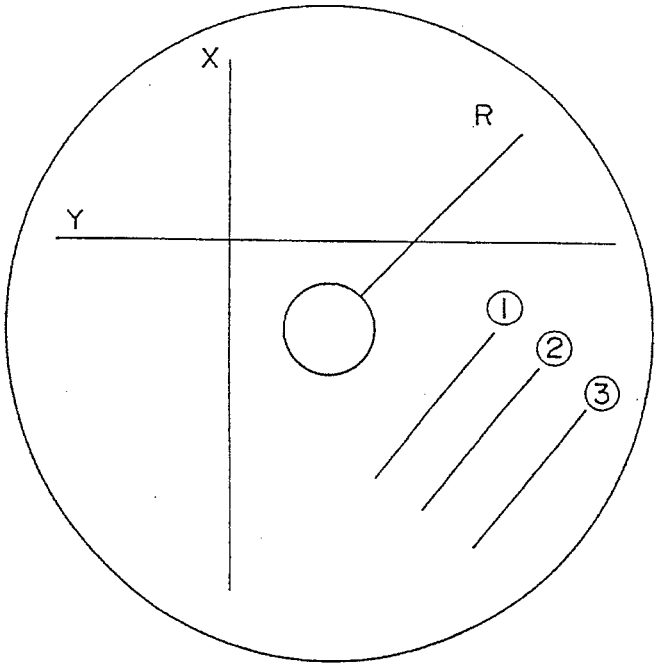
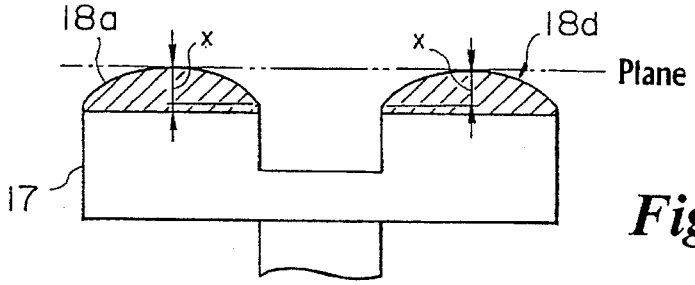
Fig. 8(A)
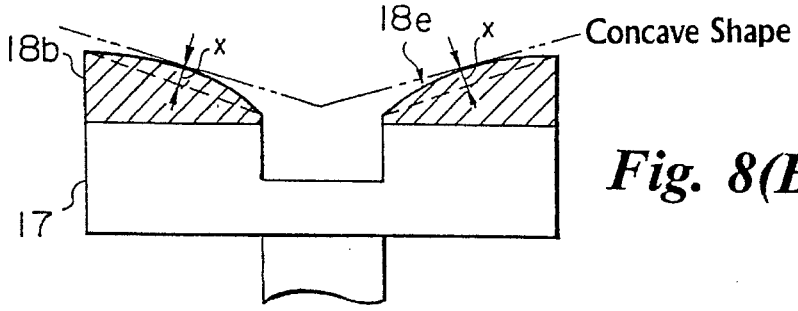
Fig. 8(B)
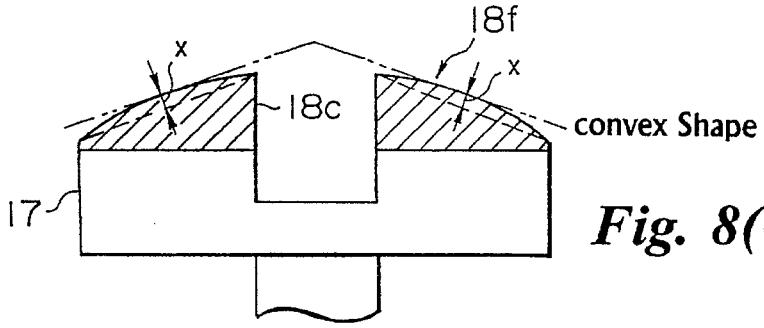
Fig. 8(C)

FLATTENING METHOD AND FLATTENING APPARATUS OF A SEMICONDUCTOR DEVICE

BACKGROUND OF THE INVENTION AND RELATED ART STATEMENT

The present invention relates to a flattening method and a flattening apparatus for a semiconductor device for flattening, by a chemical-mechanical polishing process, portions requiring flatness on uneven surfaces of elements constituting a semiconductor device, such as a metal wiring, polysilicon film, epitaxial growth film, resistance film, metal plug, silicon nitride film and inter-layer insulating film. In particular, the invention relates to a flattening method and a flattening apparatus for a semiconductor device for controlling a polishing rate by forming a surface layer or recreating a surface shape of a polishing cloth, so that the polishing rate on a whole wafer surface is kept uniform.

Recently, for producing multi-layer and high density IC and LSI, flattening of a wiring layer and an inter-layer insulating layer has been required. The word "flatness" means, for example, that a surface of the inter-layer insulating film must be formed to be a straight line parallel to the surface of a wafer and a support plate in a micro view, and to be curved so as to have the same wave as those of the surface of the wafer and the support plate in a macro view.

The reason why the flatness is required for the multi-layer IC and LSI is described hereunder. For example, in case a multi-layer IC is produced, as shown in FIGS. 22(A) through 22(E), first, a flat semiconductor support plate 1, i.e. a silicon wafer, is provided with lower layer wirings 2*a*, 2*b* and 2*c* of the same height. In the drawing, only electrodes of upper portions of the wirings are shown.

An inter-layer insulating film 3 is formed on the lower layer wirings 2*a*, 2*b* and 2*c*, then contact holes 3*a*, 3*b* and 3*c* are formed, and an upper layer wiring 4 is further formed to contact the lower wirings 2*a*, 2*b* and 2*c*.

At this time, if a thickness of the inter-layer insulating film 3 on the lower layer wirings 2*a*, 2*b* and 2*c* is not uniform, when the contact holes 3*a*, 3*b* and 3*c* are formed, the contact holes may not reach the lower layer wirings 2*a*, 2*b* and 2*c* as shown in FIG. 22(E), or the wirings may be etched, which results in cutting the wirings. Further, in case a photolithography is applied, a line width tends to be thin according to a design rule, and a wave length of ultraviolet rays becomes short, so that a focus depth becomes shallow. Therefore, in case level difference and unevenness are great, an image may not be formed. Therefore, the flatness is required for fine wirings.

Incidentally, in a semiconductor device including a logic circuit and a memory circuit, especially such as ASIC, a conventional flattening method of an inter-layer insulating film in combination of a reflow method and an etching method by subjecting to a high temperature treatment results in a high cost due to increased number of steps. This problem arises when an element includes a high density portion and a coarse density portion of a wiring, irrespective of a logic circuit or memory circuit.

As shown in FIGS. 21(A), 21(B) and 21(C), even if a surface of an inter-layer insulating film 3 is flattened by a reflow method in FIG. 21(B) and an etching method in FIG. 21(C) to obtain a flattened surface 6, when intervals among wirings 5*a*, 5*b* and 5*c* are over 200 μm, it is technically difficult to flatten the surface of the inter-layer insulating film. Therefore, in view of simplifying the process steps and lowering the cost, a chemical-mechanical polishing technique which has been used in a mirror surface polishing of a semiconductor substrate has been adopted to obtain a flattened surface of the inter-layer insulating film.

The chemical-mechanical polishing technique is a technique where, as shown in FIGS. 20(A) and 20 (B), uneven portions of an inter-layer insulating film 3 are polished to be flattened on the basis of a wafer surface 1*a*.

In the chemical-mechanical polishing technique, in case a fine area in a tip is polished, the area is to be polished in a straight line as shown in FIG. 20(A). However, when considering a wafer 1 as a whole, it is required that the inter-layer insulating film 3 is polished to accord with the unevenness of the wafer 1. More specifically, as shown by a phantom line in FIG. 20(B), the inter-layer insulating film 3 is required to be polished to accord with the unevenness (wave) of the wafer 1, which is flattened from a micro view and uniformity from a macro view.

The polishing requirements appear to be inconsistent, but it is possible to attain the requirements with improvements of a structure of a polishing apparatus and a polishing method. This improvement allows all tips a–d on the wafer 1 to be formed uniformly as shown in FIG. 19. Therefore, if the inter-layer insulating film can be polished in an equal quantity, it is beside the question whether the polishing is carried out based on a back surface or a front surface of the wafer 1.

The following flattening techniques employing the chemical-mechanical polishing process have been known as prior art.

A flattening technique is disclosed in, for example, Japanese Patent Publication (KOKOKU) No. 5-30052.

That is, "a method for producing a semiconductor device characterized in that an inter-layer insulating film for insulating between a wiring provided on the semiconductor device and a wiring provided on an upper layer thereof is interposed, and then chemical-mechanical polishing is applied thereon to thereby flatten a surface of the inter-layer insulating film" is disclosed.

The Japanese Patent Publication only discloses that the chemical-mechanical polishing apparatus is capable of polishing a plurality of wafers at a time by using the conventional polishing apparatus for polishing a mirror surface of a silicon substrate plate. However, it does not disclose any specific method and apparatus.

Further, a polishing apparatus to be used in flattening is disclosed in Japanese Patent Publication (KOHYO TOKKYO) No. 5-505769.

More specifically, "in a polishing apparatus for polishing a surface of an object to be polished including flat laying surfaces in a macro view and at least a pair of elements connected to the respective laying surfaces with a substantially equal distance away from the respective laying surfaces and disposed with a distance less than 500 μm therefrom, the surface to be polished being an upper surface of a coating layer covering the elements and the laying surfaces and being flat in a macro view and uneven in a micro view so that the elements are exposed and the surface to be polished is flattened in a micro view by polishing, said polishing apparatus comprises the following (a), (b) and (c):

(a) polishing pad means including the following (A), (B), (C) and (D);

(A) a substrate; (B) a first layer formed of an elastic material having a distortion constant higher than 6μ/psi when received a predetermined pressure over 4 psi, and affixed to one side of the substrate with an opposite side thereof as an outer surface; (C) a second layer formed of an elastic material having a distortion constant smaller than that of the first layer when received the predetermined pressure as mentioned in (B) and contacting at least the outer surface mentioned in (B) to thereby polish the opposite side thereof; and (D) a slurry liquid for polishing to be supplied to the second polishing surface as an abrasive, (b) holding means for holding an object to be polished so that a surface to be polished faces a polishing surface, and (c) a moving device for moving at least one of the polishing pad means and the holding means to the other side thereof so that the slurry liquid for polishing and the polishing surface are brought into contact with the surface to be polished to thereby polish the surface to be polished."

However, the prior art only discloses a mode of a composite polishing cloth, and does not disclose a technique for forming a surface layer of a polishing cloth required in case polishing is carried out by using the polishing cloth, or a technique for recreating a surface shape of the polishing cloth.

At present, as shown in FIG. 18, when an inter-layer insulating film 8 for insulating wirings 7 on a wafer 1 of a semiconductor device is flattened by a chemical-mechanical polishing method, a two-layer polishing cloth including an upper layer polishing cloth 9 formed of a hard synthetic resin and a lower layer polishing cloth 10 formed of a soft unwoven cloth and affixed to a support plate 11, is generally used. Incidentally, numeral 12 represents a template for a chuck for holding the silicon wafer 1, and 13 represents a backing pad.

The reason why the polishing cloth is formed of two layers is that the polishing cloth is required to have a softness to follow a wave of the silicon wafer 1 and a hardness to smooth a surface of an object to be polished. On the contrary, a suede type polishing cloth which has been generally used for polishing a mirror surface of a silicon base is very soft so that sags are created on a peripheral portion of the wafer.

However, since an area on the wafer is used as wide as possible in order to increase a yield rate, an "exclusion" is required to be as little as possible. The "exclusion" means how many millimeters are excluded from an outer periphery. Therefore, it is naturally undesirable that the sags become large on the outer peripheral portion. Thus, the suede type polishing cloth is not suitable for flattening. In case an inter-layer insulating film is polished, as a quantity to be removed is increased, the sags become large.

Also, the conventional unwoven type polishing cloth is very soft, so that the unwoven type cloth does not polish a surface to be flat and is easily damaged. Therefore, in case a semiconductor device is polished by using the chemical-mechanical polishing method, it is necessary that the polishing cloth has a two layer structure including the lower soft layer and the upper hard layer.

Further, as techniques for forming a surface layer of a polishing cloth and for recreating a surface shape of a polishing cloth, Japanese Utility Model Publication (KOKAI) No. 62-95865, Japanese Patent Publication (KOKAI) No. 4-343658 and Japanese Patent Publication (KOKAI) No. 5-177534 are mentioned.

In Publication No. 62-95865, a technique for removing polishing scraps from a polishing cloth is disclosed, and does not concern fluffing on a surface of a polishing cloth, i.e. formation of a surface layer of a polishing cloth. The technique does not disclose techniques for forming a surface layer of a polishing cloth and for recreating a surface shape of a polishing cloth according to the present invention.

Publication No. 4-343658 discloses that in case chaps, such as fluffs and waves, are created on a surface of a polishing cloth, the polishing accuracy is decreased. Also, since outer peripheral portions of an area where a wafer passes on the polishing cloth are inclined, the wafer can not be polished flat. Therefore, the chaps on the polishing cloth are corrected.

However, as described later, contrary to the concept of Publication No. 4-343658, in the present invention, the fluffs, i.e., a surface layer is intended to be formed on a polishing cloth. Also, Publication No. 4-343658 discloses that when the wafer passing portion is inclined, the wafer can not be polished flat. However, in the present invention, the surface shape of the polishing cloth is intended to be recreated so that the area where a wafer passes is positively kept in an inclined shape, convex shape, concave shape or flat shape.

Further, Publication No. 5-177534 discloses that after polishing in a high pressure area, it is desirable to correct changes, such as mesh-clogging, with passage of time of the polishing cloth in the high pressure area by carrying out grinding with a diamond dresser. However, there are not shown a technique of the present invention where a surface of a polishing cloth is fluffed to form a surface layer of the polishing cloth, and a technique where an area of the polishing cloth including a portion which slidingly contacts a wafer is positively held in the same shape, such as a convex shape, concave shape or flat shape, as that of a backing pad on a wafer holding side. In other words, recreation of the surface shape of the polishing cloth is not disclosed therein.

In "Electronics Materials" published on March, 1994, chemical mechanical polishing for inter-layer is disclosed, wherein the inter-layer is polished by a grinding pad formed of hard resin portions supported by soft elastic materials. Also, a grinding material in a slurry form is used for polishing. A support for a material to be ground is rotated on its own axis while being rotated around a different axis.

SUMMARY OF THE INVENTION

In view of the above defects, the following techniques are required for smoothing or flattening a semiconductor device by using a chemical-mechanical polishing method; (1) an area smaller than one tip is polished in a straight line parallel to a surface of a wafer base; and (2) an inter-layer insulating film has a uniform thickness by removing an equal quantity, irrespective of the density of wirings when a whole surface of the wafer is viewed. The present invention is to provide a polishing method and a polishing apparatus to meet the above requirements.

A flattening method of a semiconductor device for flattening by a chemical-mechanical polishing process of the present invention is characterized by carrying out formation of a surface layer and/or recreation of a surface shape of a polishing cloth having a hardness of higher than 80, preferably from 90 to 110, and most preferably 95 according to c scale of JIS-6301, at an initial stage, in the middle of polishing process, continuously in the polishing process, or before termination of the polishing process.

A flattening apparatus of a semiconductor device for flattening by a chemical-mechanical polishing process of the present invention is characterized by a tool for carrying out formation of a surface layer and/or recreation of a surface shape of a polishing cloth having a hardness of higher than 80, preferably from 90 to 110, and most preferably 95 according to c scale of JIS-6301, at an initial stage of a polishing process, in the middle of the polishing process, continuously in the polishing process, or before termination of the polishing process.

BRIEF DESCRIPTION OF THE DRAWINGS

FIG. 7 is a diagram showing measuring directions on a surface of a polishing cloth on a support plate;

FIG. 8(A) is a cross section view showing a whole surface shape of a polishing cloth on a support plate according to the present invention;

FIG. 8(B) is a cross section view showing a whole surface shape of another polishing cloth on a support plate according to the present invention;

FIG. 8(C) is a cross section view showing a whole surface shape of still another polishing cloth on a support plate;

DETAILED DESCRIPTION OF PREFERRED EMBODIMENTS

In view of the defects described in the prior art, in the present invention, experiments were carried out by using a hard synthetic resin polishing cloth different from a conventional suede type polishing cloth which has been used in a mirror polishing of a silicon semiconductor substrate, and the following results were obtained.

(1) A polishing speed is lowered as time for using a polishing cloth passes.

(2) When the polishing speed is lowered, polishing quantity on a whole wafer surface becomes ununiform.

(3) Immediately after a dressing is carried out by using the polishing cloth to form a surface layer, the polishing quantity on the whole wafer surface becomes nearly uniform. Hereinafter, in the description of the present invention, the words "dressing" and "surface layer formation" are used synonymously.

Figure 17:
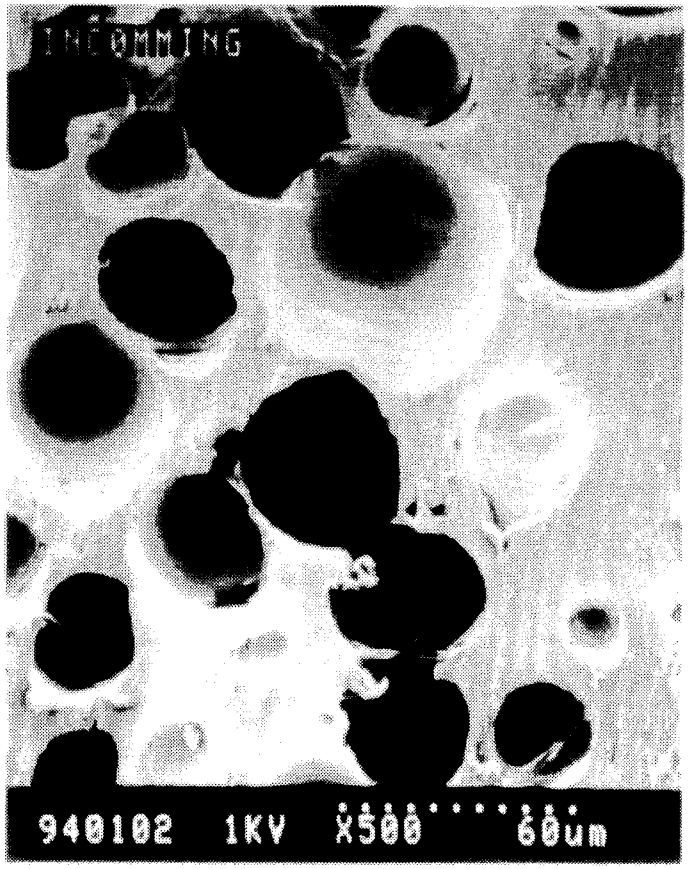
FIG. 17 is a plan view taken by the scan type electron micrograph of the hard synthetic resin polishing cloth for constituting the polishing cloth used in the embodiment of the present invention when dressing of the hard synthetic resin polishing cloth was not carried out.
Figure 16:
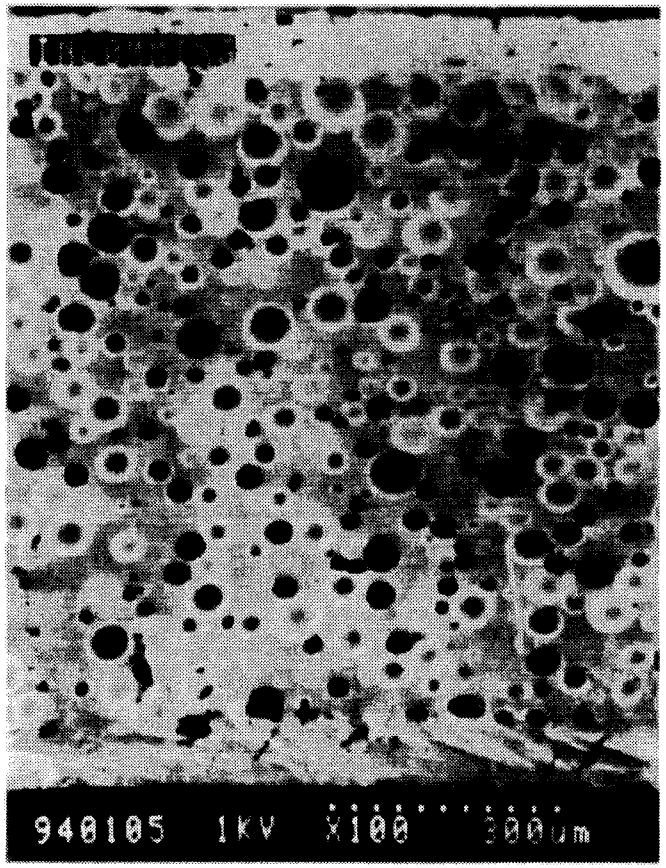
FIG. 16 is a cross section view taken by a scan type electron micrograph of a hard synthetic resin polishing cloth for constituting a polishing cloth used in an embodiment of the present invention when dressing of the hard synthetic resin polishing cloth was not carried out.
Figure 18:
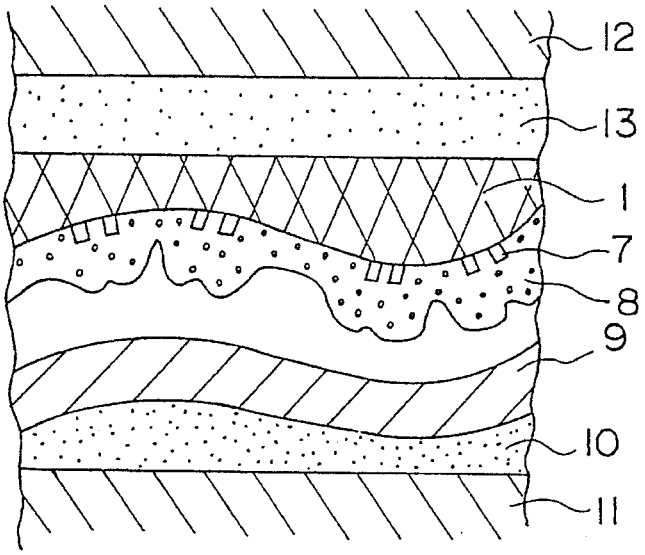
FIG. 18 is a cross section showing an essential part for explaining polishing of an inter-layer insulating film by a conventional two-layer polishing cloth.
Figure 19:
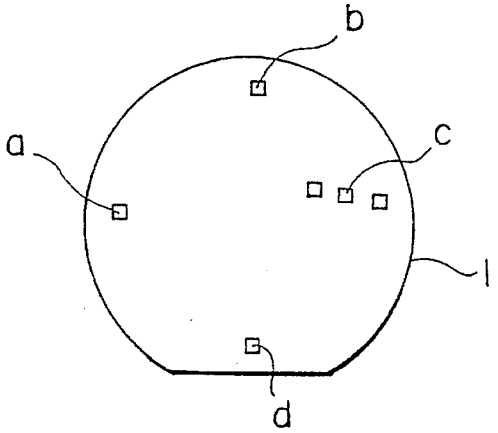
FIG. 19 is a diagram showing a relationship of a wafer and tips.
Figure 20A:
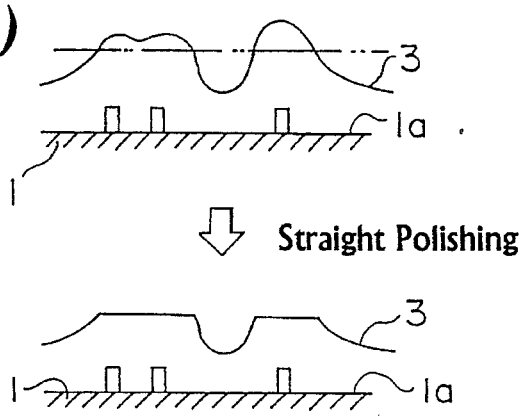
FIG. 20(A) is a diagram showing an example for polishing a fine area in a tip.
Figure 20B:
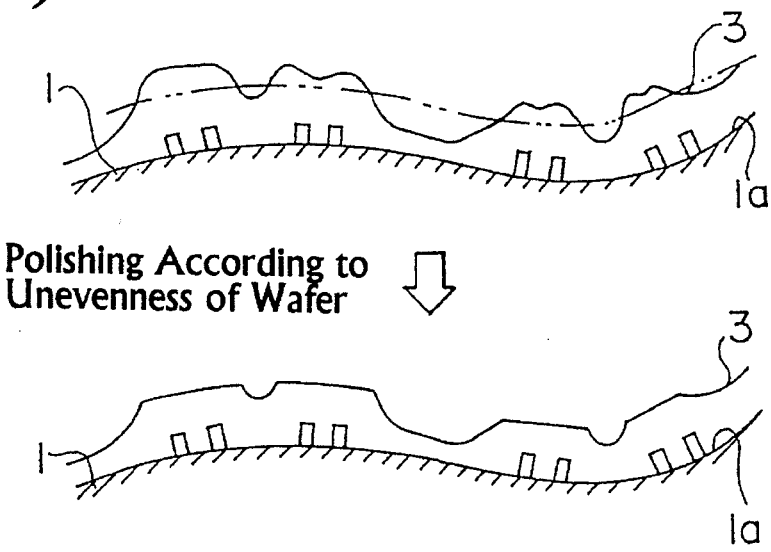
FIG. 20(B) is a diagram showing an example for polishing an inter-layer insulating film to accord with a wave of a wafer.
Figure 21A:
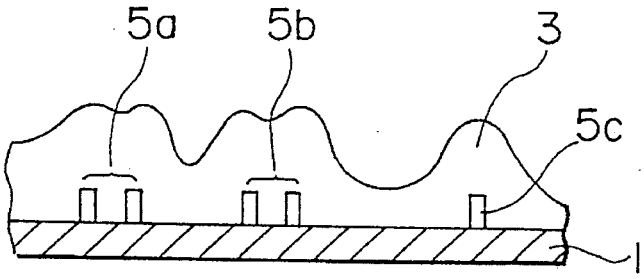
FIG. 21(A) is a diagram showing an inter-layer insulating plate.
Figure 21B:
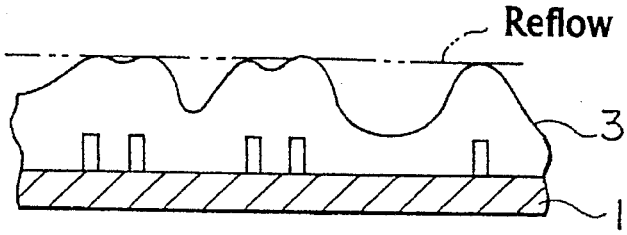
FIG. 21(B) is a diagram showing an example for flattening an inter-layer insulating plate of a semiconductor device by a reflow method.
Figure 21B:
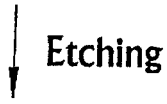
Figure 21C:
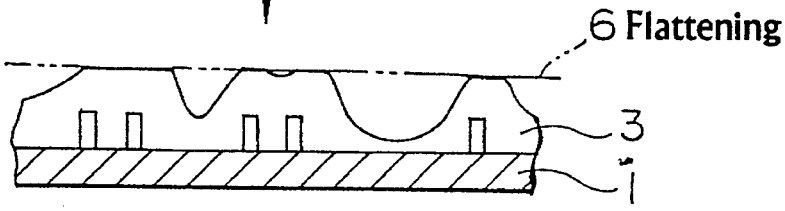
FIG. 21(C) is a diagram showing an example for flattening an inter-layer insulating plate of a semiconductor device by an etching method.
Figure 22A:
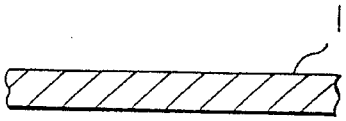
FIGS. 22(A), 22(B), 22(C), 22(D) and 22(E) are diagrams for explaining problems of a multi-wiring semiconductor device.
Figure 22B:
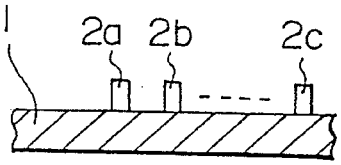
Figure 22C:
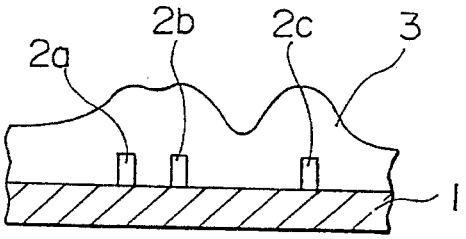
Figure 22D:
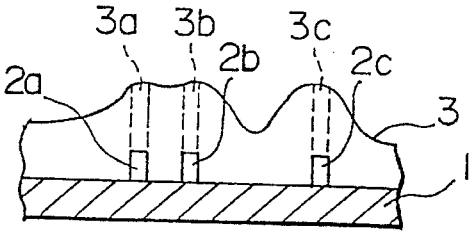
Figure 22E:
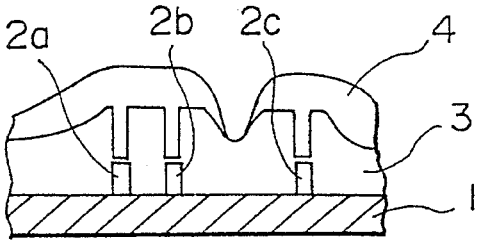

A new or incoming hard resin polishing cloth is shown in cross section in FIG. 16 by 100 times enlargement by a scan type electron micrograph (hereinafter referred to as "SEM") and in plan in FIG. 17 by 500 times enlargement by the SEM. The surface states or conditions of the polishing cloth were observed (1) immediately after the incoming hard resin polishing cloth was subjected to dressing; (2) after the hard resin polishing cloth was subjected to a polishing process; and (3) after the hard resin polishing cloth was used for polishing while subjecting to dressing.

Figure 12:
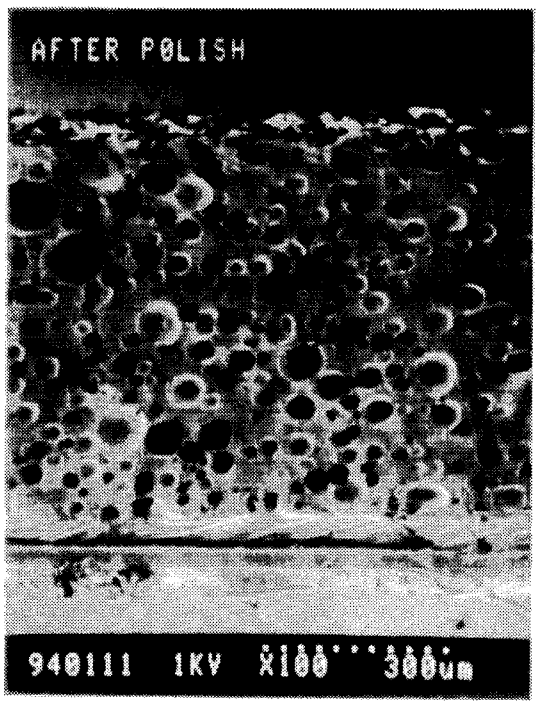
FIG. 12 is a cross section view taken by a scan type electron micrograph of a hard synthetic resin polishing cloth for constituting a polishing cloth used in an embodiment of the present invention after polishing was carried out by the hard synthetic resin polishing cloth.
Figure 11:
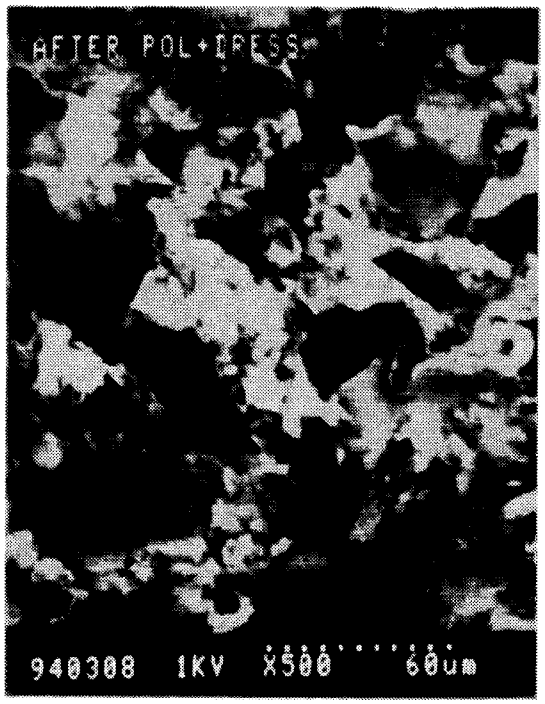
FIG. 11 is a plan view taken by the scan type electron micrograph of the hard synthetic resin polishing cloth for constituting the polishing cloth used in the embodiment of the present invention when dressing of the hard synthetic resin polishing cloth was carried out during the polishing process.
Figure 10:
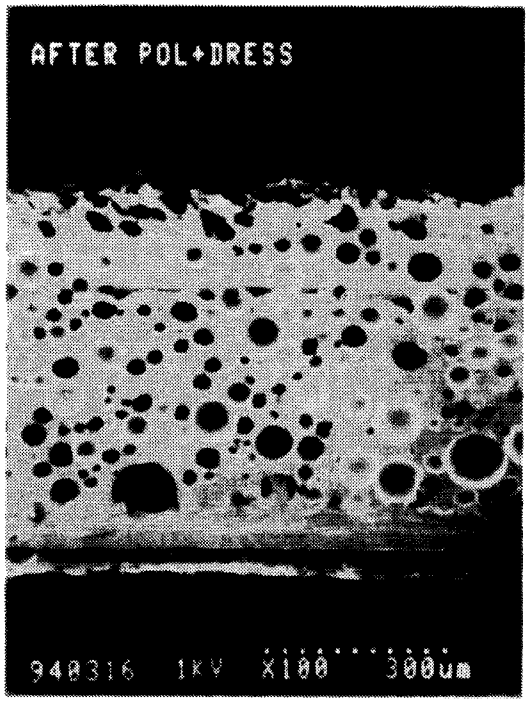
FIG. 10 is a cross section views taken by a scan type electron micrograph for a hard synthetic resin polishing cloth when dressing of the cloth during the polishing process.
Figure 14:
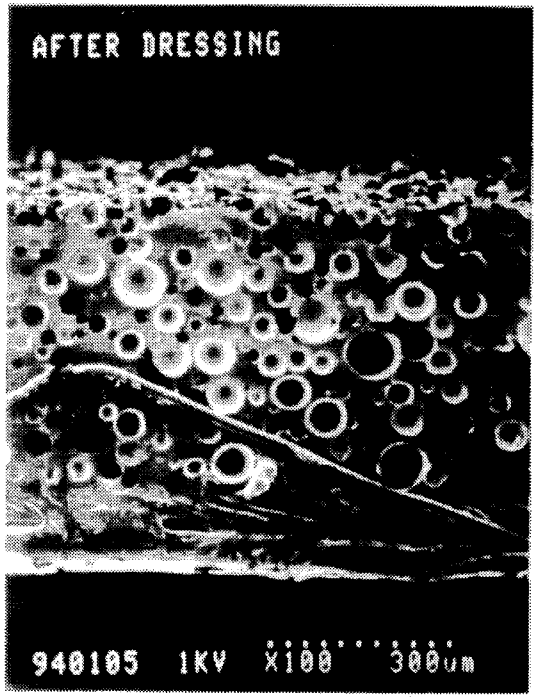
FIG. 14 is a cross section view taken by a scan type electron micrograph of a hard synthetic resin polishing cloth for constituting a polishing cloth used in an embodiment of the present invention after dressing of the hard synthetic resin polishing cloth was carried out.
Figure 13:
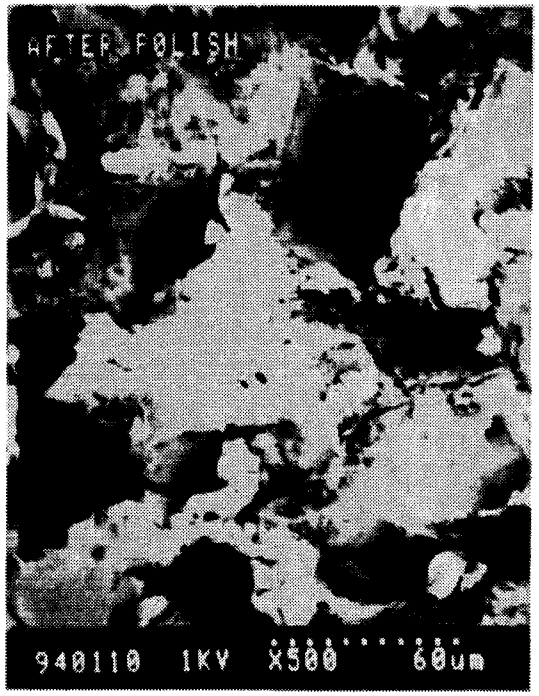
FIG. 13 is a plan view taken by the scan type electron micrograph of the hard synthetic resin polishing cloth for constituting the polishing cloth used in the embodiment of the present invention after polishing was carried out by the hard synthetic resin polishing cloth.
Figure 15:
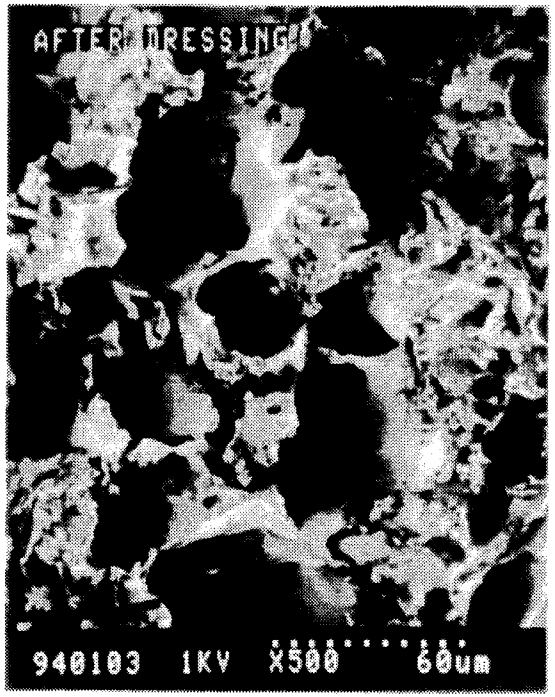
FIG. 15 is a plan view taken by the scan type electron micrograph of the hard synthetic resin polishing cloth for constituting the polishing cloth used in the embodiment of the present invention after dressing of the hard synthetic resin polishing cloth was carried out.

FIG. 14 shows an SEM enlarged by 100 times of a cross section of the polishing cloth after dressing. FIG. 15 shows an SEM enlarged by 500 times of a plane of the polishing cloth after dressing. FIG. 12 is an SEM enlarged by 100 times of a cross section of the polishing cloth after polishing. FIG. 13 is an SEM enlarged by 500 times of a plane of the polishing cloth after polishing. FIG. 10 is an SEM enlarged by 100 times of a cross section of a polishing cloth after dressing of the polishing cloth was carried out while polishing. FIG. 11 shows an SEM enlarged by 500 times of a plane of the polishing cloth after the surface layer was formed while polishing.

As a result of observations of the SEMs, fluffs of about 70 μm can be seen on the surface of the polishing cloth immediately after the dressing was carried out in the cross section shown in FIG. 14. However, after the polishing, the fluffs only have a height of about 30 μm even in the highest area as shown in FIG. 12. Further, there are some areas where the fluffs are plucked, and other areas where the fluffs are shaved and flattened.

On the other hand, as shown in FIG. 10, fluffs of about 70 μm are uniformly formed on the whole surface of the polishing cloth in case the dressing was carried out while polishing.

From the above observations, the following can be considered.

(1) In case the surface layer formation or dressing was not carried out, fluffs were not formed on the surface of the polishing cloth. In other words, abrasive particles contained in an abrasive were rolled on the surface of the polishing cloth, or washed away together with the abrasive liquid to thereby not fully contribute to the polishing.

(2) In case the dressing was carried out, the fluffs were uniformly formed on a surface of the polishing cloth, and the abrasive particles contained in the abrasive were held in the fluffs, so that when a wafer passed through, the fluffs were pushed down and rubbed against the wafer. At this time, the wafer is polished by the abrasive particles held in the fluffs. More specifically, when compared to a diamond grind stone, the abrasive particles held in the fluffs correspond to diamond grains, and the abrasive particles held in the fluffs correspond to cutting edges of the diamond grains.

(3) As time in using the polishing cloth passes, the fluffs are not formed on the polishing cloth, so that the abrasive particles are not held in the fluffs to thereby reduce a polishing speed.

(4) As time in using the polishing cloth passes, the fluffs become uneven on the surface of the polishing cloth, so that some portions where the fluffs are formed hold the abrasive particles therein, and other portions where the fluffs are plucked do not hold the abrasive particles. Therefore, a predetermined polishing speed can not be obtained.

Figure 9A:
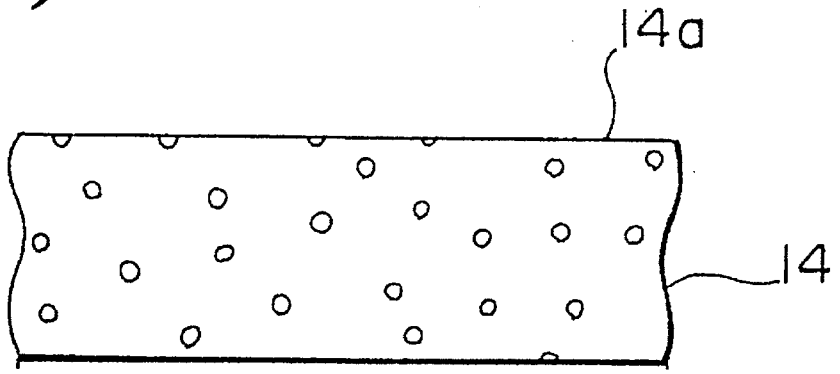
FIG. 9(A) shows a surface, without fluffs, of a polishing cloth formed of a hard foamed polyurethane.

(5) Therefore, unless the fluffs are constantly formed on a surface 14*a* of a polishing cloth 14 formed of, for example, a hard foamed polyurethane as shown in FIG. 9(A), a predetermined polishing speed can not be obtained. Thus, it is apparent that the surface of the polishing cloth should have fluffs 14*b*, as shown in FIG. 9(B), by carrying out a polishing process while performing dressing at a necessary time, for example, at an initial stage, at a middle stage, continuously in the course, or before termination, of the polishing.

As described later, it is suitable that the dressing of the surface of the polishing cloth is made continuously during the polishing process so that fluffs are uniformly formed on the surface by the dressing to thereby obtain a stable polishing speed.

Figure 9B:
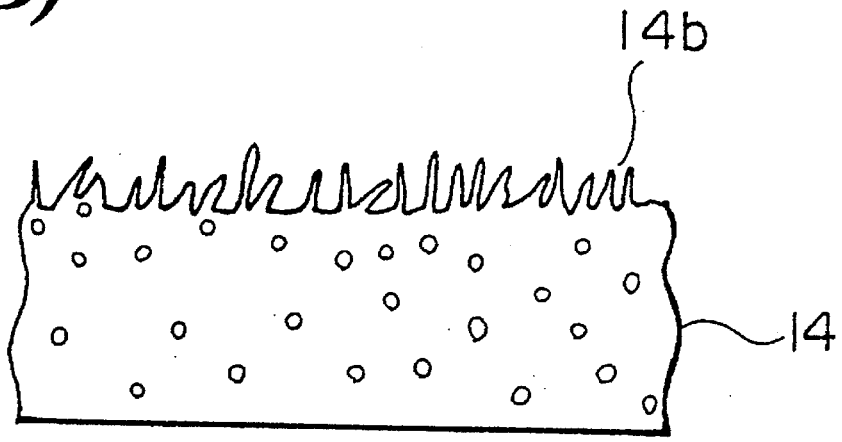
FIG. 9(B) shows a fluffed surface of a polishing cloth formed of a hard foamed polyurethane.

From the foregoing, it is clear that a polishing speed can be kept constant by dressing of the surface of the polishing cloth 14, as shown in FIG. 9(B), in the course of the polishing process, and at the same time with the constant polishing speed, even in case a number of wafers are polished, a uniform polishing quantity can be attained on the whole surface of each wafer. Therefore, lot uniformity can be improved, as described later.

Also, from the experiences of the mirror surface polishing of a silicon base in a wafer process, the present inventors paid attention to a point that the flatness of a wafer surface is a transcription of the flatness of the surface of the polishing cloth affixed to a support plate, and carried out an experiment on recreation of a surface shape of a polishing cloth described later, assuming that flatness of the surface of the polishing cloth also influences the uniformity.

Further, from experiments described later, the following point became apparent. In FIGS. 8(A)–8(C), as shown by imaginary lines, irrespective of the whole surface shapes of the polishing cloths 18*a*, 18*b* and 18*c* where apexes of the maximum thicknesses x contact the imaginary lines, i.e., a flat shape, a concave shape or a convex shape, it is necessary that areas 18*d*, 18*e* and 18*f* including areas where respective wafers pass on the polishing cloths on the support plates 17 positively hold shapes so as to conform to respective shapes of backing pads for holding wafers. In other words, it is necessary to recreate a surface shape of the polishing cloth at an initial stage, at a middle stage, continuously in the course of polishing process, or before termination, of a polishing process.

Based on the above concept, it is assumed that a wafer carrier for pressing the wafer against the polishing cloth by holding with a chuck includes a backing pad on a wafer holding surface, which has the same structure as that of the polishing cloth, and in case the backing pad is formed in a concave shape opposite to the convex shape of the polishing cloth on the support plate, higher uniformity can be obtained.

In other words, when the backing pad surface and the polishing cloth surface have the same curvature, high uniformity can be obtained.

Incidentally, as shown in Table 1 as "Flatness Variation in a Radial Direction of a Polishing Cloth Surface", flatness of the polishing cloth was measured immediately after polishing was carried out while dressing and recreating a surface of the polishing cloth. As a result, in case a shape of a backing pad for holding a wafer was in a concave shape, the flatness in the radial direction of the polishing cloth was maintained by continuously recreating the surface of the polishing cloth in the polishing process so as to keep a convex shape in the radial direction, irrespective of the shapes of the polishing cloths in a diametrical direction as shown by the imaginary lines in FIG. 8(A)–8(C), i.e., a convex shape, a concave shape or a flat shape. On the other hand, the flatness changed in case recreation of the surface of the polishing cloth was carried out every time when one wafer was polished, and a plurality of wafers was polished.

More specifically, a maximum thickness x as shown in FIG. 8(A)–8(C) was changed in respective samples 1–3 by 4–6 μm in case the recreation of the surface of the polishing cloth was not carried out. On the other hand, the maximum thicknesses x for all samples 4–6 did not substantially change in case the recreation of the surfaces of the polishing cloths was carried out by continuously recreating the polishing cloths in the polishing process.

TABLE 1

Flatness Variation in a Radial Direction of a Polishing Cloth Surface (Convex: +; Concave: –)

| Condition | Sample No. | Before Polishing | After Polishing | Variation |
|---|---|---|---|---|
| 10 wafers were polished after re-creation | 1 | +19 | +15 | –4 |
| | 2 | +20 | +14 | –6 |
| | 3 | +18 | +13 | –5 |
| Wafers were polished while recreating surface | 4 | +11 | +11 | 0 |
| | 5 | +10 | +11 | +1 |
| | 6 | +10 | +10 | 0 |

In view of the above results, the invention described later solves the following points.

(1) A wafer which is flat in a micro view and uniform in a macro view can be obtained by flattening a semiconductor device by means of chemical mechanical polishing.

(2) On every tips, wafer insulating films on a semiconductor device can be formed uniformly.

(3) An inter-layer insulating film can be polished in an equal quantity irrespective of wiring density.

(4) A predetermined polishing rate can be obtained to polish an equal quantity of an inter-layer insulating film.

(5) A wafer surface and a polishing cloth contact in parallel or with the same curvature.

Hereinunder, an embodiment of the present invention is described based on FIGS. 1 through 4. FIG. 1(A) is a cross section of an essential part, FIG. 1(B) is a plan view showing a positional relationship of a polishing cloth, wafer, tool for forming a surface layer or recreating a shape of the surface (hereinafter referred to as simply "tool"), and backing pad.

In FIG. 1, reference numeral 17 is a support plate; 18 is a polishing cloth; 19 is a vacuum chuck; 20 is a wafer for forming a semiconductor device (hereinafter referred to as "wafer"); 21 is a tool; 22 is a tool arm; and 23 is a backing pad.

In the above structure, the wafer 20 held in the rotatable and vertically movable vacuum chuck 19 through the backing pad 23 is pressed against the polishing cloth 18 affixed to a surface of the rotatable support plate 17 by an adhesive to polish a surface of the semiconductor device, for example, an inter-layer insulating film (not shown), formed on a surface of the wafer 20. At the same time, a surface layer of the polishing cloth 18 is formed or a surface shape of the polishing cloth 18 is recreated by moving the tool 21, which, generally, includes the tool arm 22 formed of a material handle or a robot, in an X direction or in a Y direction (in a peripheral direction of a polishing cloth), or by shaking the tool 21 along the surface of the polishing cloth.

The polishing cloth 18 is formed of a lower layer 18*h* disposed on a side of the support layer 17 and made of a soft and elastic polyurethane unwoven cloth SUBA-400 (produced by Rodel, Inc.) having a hardness of 61 according to c scale of JIS K-6301, and an upper layer 18*g* for polishing the wafer 20 made of a hard foamed polyurethane polishing cloth IC-1000 (produced by Rodel, Inc.) having a hardness of 95 according to c scale of JIS-K-6301.

Figure 2A:
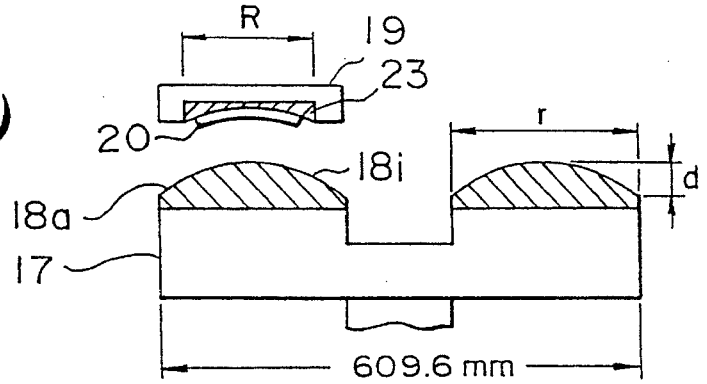
FIG. 2(A) is a diagram showing a variation of flatness of a backing pad.
Figure 2B:
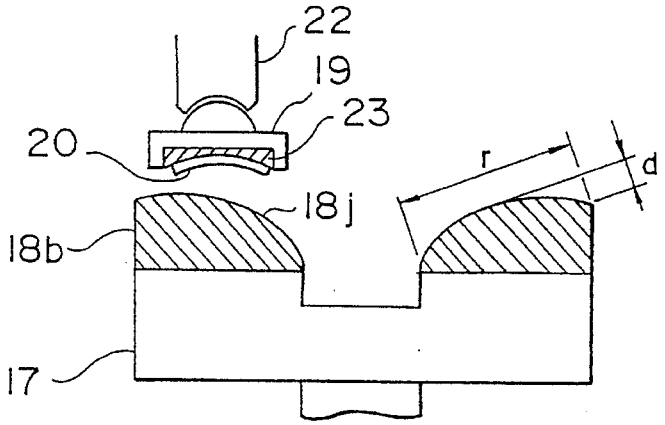
FIG. 2(B) is a diagram showing a variation of flatness of another backing pad.
Figure 4A:
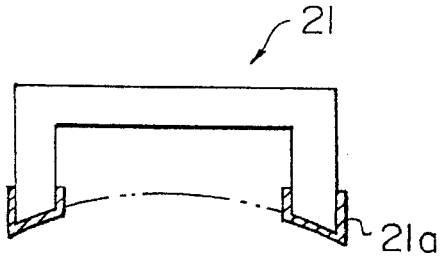
FIG. 4(A) shows a tool in a ring shape to be used in the present invention.
Figure 4B:
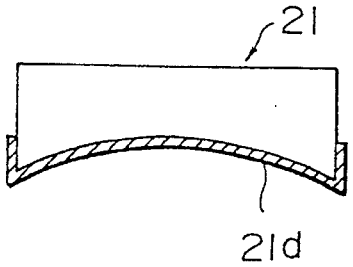
FIG. 4(B) shows another tool in a disc shape to be used in the present invention.

FIGS. 4(A) and 4(B) show embodiments of the tool 21. The tool 21 having a surface shape corresponding to that of the backing pad 23 on the side where the wafer 20 is held as shown in FIGS. 2(A) and 2(B), is used. In other words, a tool having the same curvature as that of the backing pad 23 on the side of the wafer is used. Because coincidence of both curvatures is most effective to keep a shape of the polishing cloth in a radial direction as described later.

Figure 1A:
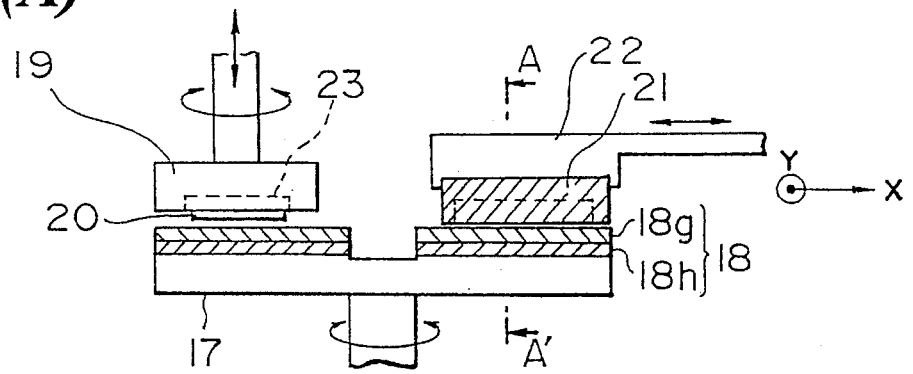
FIG. 1(A) is a cross section view of an essential part of the present invention.

The tool 21 shown in FIG. 4(A) is coated with diamond 21*a* at a tip of a stainless steel ring by a plasma CVD method or an electro-deposition process to form a diamond coating portion. The diamond coating portion of the tool 21 contacts the upper layer 18*g* of the polishing cloth 18 as shown in FIG. 1(A), and includes an under surface of the ring and lower end portions on both the inner and outer peripheries of the ring. The under surface of the ring has the same shape as that of the backing pad 23 as shown in FIG. 1(A).

Figure 1B:
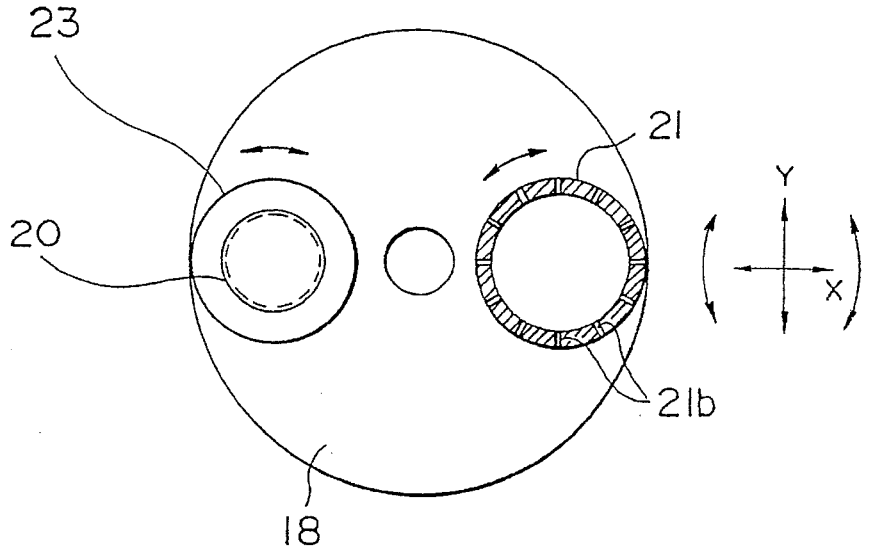
FIG. 1(B) is a plan view showing a positional relationship of a polishing cloth, wafer, tool and backing pad.

Further, the tool 21 is provided with a plurality of slits 21*b* having a width of, for example 5 mm, in equal intervals from an under surface side thereof for allowing an abrasive to pass therethrough, as shown in FIG. 1(B).

The tool shown in FIG. 4(B) is formed by coating diamond 21*d* on a whole surface of a stainless steel or ceramic disc having the same curvature as that of the backing pad on a side where a surface layer of the polishing cloth is formed or a surface shape of the polishing cloth is recreated, by a plasma CVD method or an electro-deposition method.

Figure 4C:
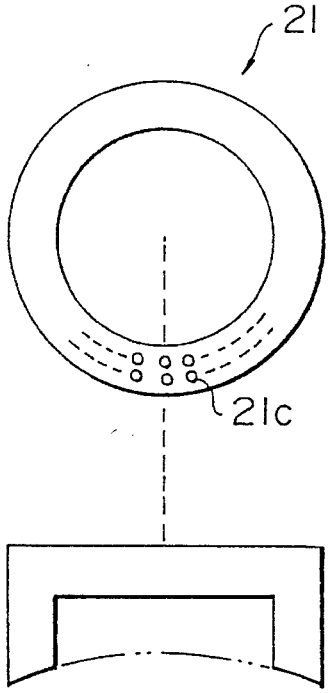
FIG. 4(C) shows a tool in a ring shape with projections to be used in the present invention.

The tool shown in FIG. 4(C) is formed of a ceramic ring provided with a plurality of projections 21*c* on a ring top surface. The projections 21*c* are formed, for example, with a height of 1.5 mm, a diameter of 1.5 mm and a pitch of 2 mm in a peripheral direction and in a direction perpendicular to the peripheral direction. The surface including the ring top surface provided with the projections has the same curvature as that of a backing pad as described before.

Two experiments were carried out by using a polishing apparatus having the structure as described above. The experiments are described hereunder. In the two experiments, common conditions are described below:

(1) A silicon wafer having a diameter of 8 inches was coated with a silicon dioxide film as an oxide film on one side thereof, and the coated silicon wafer was polished on a side of the oxide film.

(2) The number of the wafers which were polished at one time was one.

(3) The experiments were carried out under the same conditions of pressure, rotation, abrasive and slurry flow quantity.

(4) After polishing, each wafer was washed, and the film thickness of the oxide film was measured at predetermined 49 points on the wafer to determine whether the wafer was uniformly polished in the respective 49 points, or whether equal qualities on the respective 49 points were removed. Based on the following equation, uniformity is shown as percentage.

Uniformity of each wafer={(Max−Min)/2×X}×100

In the equation, Max represents a maximum value of the polishing quantity per unit time (minute), Min represents a minimum value of the polishing quantity per unit time, and X represents an average value of polishing quantities at, for example, the 49 points. In case a figure of the uniformity is small, the wafer 20 is polished uniformly, and each tip in the wafer 20 is polished at the same polishing rate.

Incidentally, uniformity of each wafer is measured by measuring polishing quantities, for example, on the 49 points of the wafer, and the maximum value "Max" and the minimum value "Min" of the polishing quantities are measured on each polished wafer. On the other hand, lot uniformity of a plurality of wafers, for example 10 wafers as a lot, is measured from polishing quantities on 490 points of the wafers. However, the uniformity of each wafer and the lot uniformity of the lot wafers do not always coincide.

Moreover, the lot uniformity is generally lowered as the number of the lot becomes large. However, from the experiments described later, it has been found that the lot uniformity is improved when a predetermined polishing rate is kept.

Hereunder, the two experiments and the results are described.

EXPERIMENT 1

Figure 5:
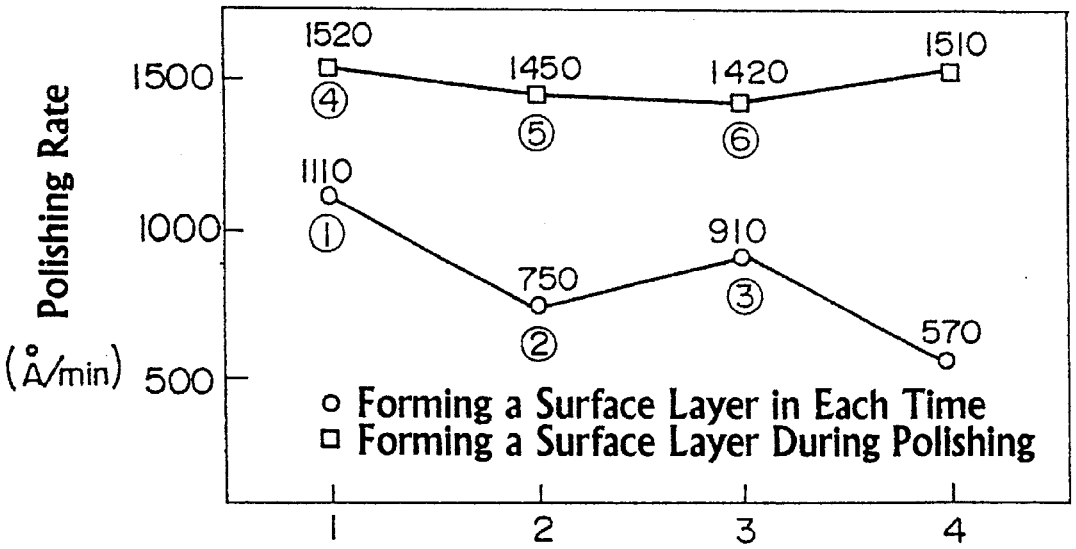
FIG. 5 is a graph showing a relationship between polishing rate and polishing number when a surface layer of a polishing cloth was formed in an embodiment of the present invention.
Figure 6:
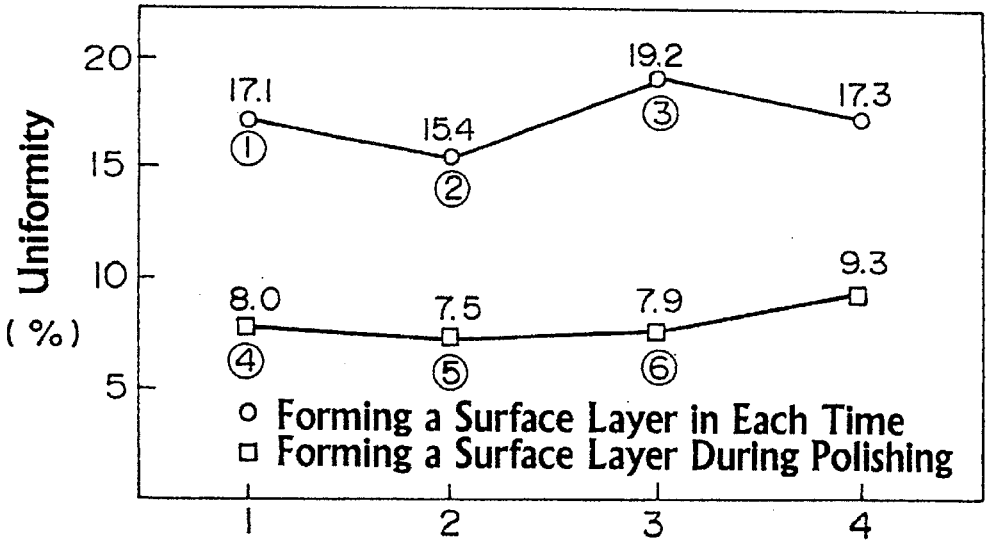
FIG. 6 is a graph showing a relationship between uniformity and polishing number when a surface layer of a polishing cloth is formed in the embodiment of the present invention.

Polishing rates and uniformities when a surface layer of a polishing cloth was formed in each time and when a surface layer was continuously formed in the polishing process were compared, and graphs as shown in FIGS. 5 and 6 were obtained.

FIG. 5 is a graph showing a relationship between the polishing rate (Å/min) and the number of polished wafers, and FIG. 6 is a graph showing a relationship between the uniformity (%) and the number of polished wafers.

From the experiments, it is found that when the surface layer of the polishing cloth was continuously formed in the polishing process, the polishing rate was stable. On the other hand, when the surface layer was formed every time after one wafer was polished and the surface layer formation was not carried out during the polishing process, the polishing rates changed and were not stable.

On one hand, when the surface layer of the polishing cloth was intermittently formed in the polishing process, the polishing rate was high and its variation was small and uniform. As shown in FIG. 6, the uniformity thereof was also small and was improved.

Further, it comes to a conclusion that the lot uniformity was improved by intermittently forming the surface layer in the polishing process so as to keep the polishing rate uniform.

EXPERIMENT 2

Comparison was made on uniformities in case a surface shape of a polishing cloth was recreated and in case a surface shape of a polishing cloth was not recreated.

In Experiment 2, a surface shape of a polishing cloth was measured in directions shown by lines, such as X, Y, R, (1), (2) and (3), in FIG. 7.

From the results of the experiments, the whole surfaces of both the polishing cloths in case the surface shape of the polishing cloth was recreated and in case the surface shape of the polishing cloth was not recreated, showed a concave shape as shown by an imaginary line in FIG. 8(B). However, in case the surface shape was not recreated, the concave shape had further fine uneven portions formed on an area of the polishing cloth including a portion where a wafer passed.

On one hand, in case the surface shape of the polishing cloth was recreated, an area **18*e* including a portion, where a wafer 20 passed, of the polishing cloth 18*b* fixed to a support plate 17** showed almost no variation in an x value, and the surface shape of the polishing cloth was kept in a concave shape as shown by the imaginary line.

The results of measurements of the surface shapes of the polishing cloths are shown in Table 2. From the results of the measurements, in case a polishing process was carried out by using a polishing cloth where surface shape was formed before the polishing process was started and surface shape was recreated continuously in the polishing process, the surface shape of the polishing cloth was kept in a convex shape and improved in its uniformity, when compared with a case where a surface shape of a polishing cloth was recreated only before the polishing process was started.

On one hand, in case the surface shape of the polishing cloth was recreated only before a polishing process was carried out, the surface shape of the polishing cloth was changed to a concave shape, so that the convex shape which had been held before the polishing process was carried out could not be maintained, and the uniformity was not improved. Incidentally, in Table 2, "+" represents a convex shape and "−" represents a concave shape.

TABLE 2

Measurement Results of Surface Shapes of Polishing Cloths (Unit: μm)

| | X | Y | R | (1) | (2) | (3) |
|---|---|---|---|---|---|---|
| Polishing cloth where surface shape was recreated beforehand | +20 | +10 | +8 | +6 | +1 | −1 |
| Polishing cloth where surface shape was not recreated | −40 | −58 | −3 | −6 | −5 | 0 |
| Polishing cloth where surface shape was recreated | +20 | +11 | +8 | +5 | +1 | −2 |

Tables. 3 and 4 show numeral results obtained from experiments relating to curvatures of a polishing cloth surface and a backing pad provided between a wafer and a vacuum chuck.

TABLE 3

Flatness of Backing Pads (Unit: μm)

| Flatness of polishing cloth surface in a radial r direction (r = 280 mm) | Diameter ϕ of polishing cloth surface (ϕ = 609.6 mm) | d = +8 μm | d = +10 μm |
|---|---|---|---|
| Flatness of backing pad in a diametrical direction R | Diameter ϕ of wafer (6 inch) | −4 μm | −4.5 μm |
| | Diameter ϕ of wafer (8 inch) | −6.5 μm | −8 μm |

Figure 2C:
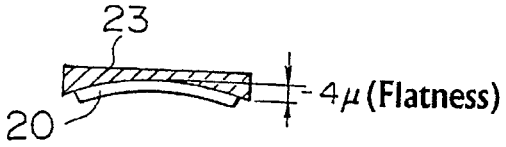
FIG. 2(C) is a diagram showing a variation of flatness of a backing pad.
Figure 2D:
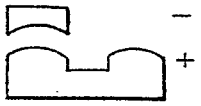
FIG. 2(D) shows cross sections in a concave shape of a backing pad.
Figure 2E:
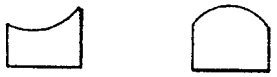
FIG. 2(E) is diagram showing cross sections in a concave shape with "–" and a convex shape with "+"

Table 3 shows flatnesses of a backing pad 23 in a diametrical direction R in case wafers having diameters 6" and 8" were polished when polishing cloths of a diameter of 609.6 mm have surface shapes of convex degrees d of +8 μm and +10 μm in a distance of a radius r, about 280 mm, as shown in FIGS. 2(A), 2(B) and 2(C). Symbols "+" and "–" attached to the numerals shown in Table 3 represent a convex shape and a concave shape in cross section, respectively, as shown in FIGS. 2(D) and 2(E).

Based on the experimental results shown in Table 3, it is found that uniformity can be improved by setting flatness of the backing pad 23 to a convex degree d of the polishing cloth 18*a* or 18*b* (FIGS. 2(A) and 2(B)) in a radial direction r and to a flatness corresponding to a diameter of the wafer.

In other words, since the flatness of the backing pad 23 (FIG. 2(C)) approximately coincides with the shapes of the polishing cloths 18*a* and 18*b* (FIGS. 2(A) and 2(B)), the wafer 20 is pressed against the polishing surfaces 18*i* and 18*j* of the polishing cloths 18*a* and 18*b* with an equal pressure.

Therefore, uniformity can be improved by recreating the surface shape of the polishing cloth in the course of the polishing process. For example, an inter-layer insulating film can be removed in an equal quantity from the surface thereof.

Incidentally, in FIG. 2(B), 22 represents a universal joint.

Figure 3:
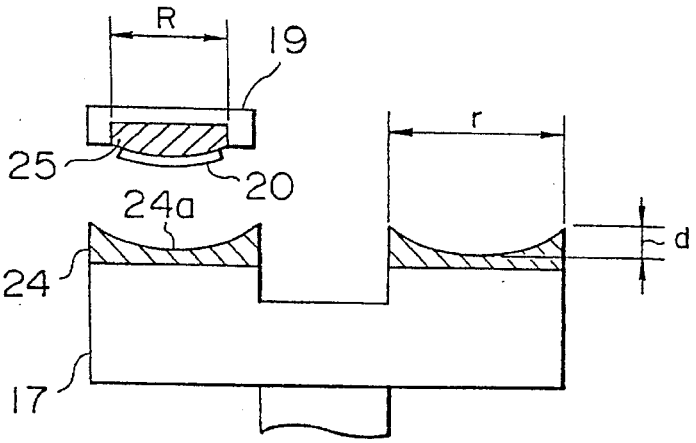
FIG. 3 is a diagram showing a variation of flatness of a backing pad.

Table 4 shows flatness of the backing pad 25 in a diametrical direction R in case wafers 20 having diameters 6" and 8" were polished when a polishing cloth 24 of a diameter of 609.6 mm had surface shapes of concave degrees d of –8 μm and –10.5 μm in a distance of a radius r of about 280 mm, as shown in FIG. 3.

TABLE 4

| | Flatness of Backing Pads (Unit: μm) | | |
|---|---|---|---|
| Flatness of polishing cloth surface in a radial r direction (r = 280 mm) | Diameter ϕ of polishing cloth surface (ϕ = 609.6 mm) | d = –8 μm | d = –10.5 μm |
| Flatness of backing pad in a diametrical direction R | Diameter ϕ of wafer (6 inch) | +4 μm | +5 μm |
| | Diameter ϕ of wafer (8 inch) | +6.5 μm | +8 μm |

Based on the experimental results shown in Table 4, it is found that uniformity can be improved by setting flatness of a backing pad 25 to a convex degree d of the polishing cloth 24 in a radial direction r and to a flatness corresponding to a diameter of the wafer.

In other words, since the flatness of the backing pad 25 accords with the surface shape of the polishing cloth 24, the wafer 20 is pressed against a polishing surface 24*a* of the polishing cloth 24 to be polished with uniform pressure.

Therefore, in this case, also, uniformity can be improved by continuously recreating the surface shape of the polishing cloth in the polishing process. For example, an inter-layer insulating film can be removed from a surface in an equal quantity.

In the above description of an embodiment of the present invention, while an equation for calculating the uniformity was used, an equation for obtaining non-uniformity from a standard variation may be used for calculating the uniformity. The equation is shown as follows:

$$Sx=\sqrt{\{(\Sigma x^2-nX^2)/(n-1)\}}$$

wherein Sx represents a standard variation, x represents a polishing quantity per unit time, X represents an average value of polishing quantity per unit time, and n represents the number of samples. When the present invention is carried out, since elution of metal, such as a nickel, for forming a base of a tool results in contamination or short circuit of the instrument, it is necessary to prevent the metal portion from being contacted with a polishing liquid.

When a polishing cloth is hard, the polishing cloth may be formed of one layer or more than three layers. The tool used in the invention may be a diamond grind stone.

In the above embodiment, although the description was made in respect to polishing of an insulating film of a semiconductor device, especially an inter-layer insulating film, the present invention can be applied to flattening and uniforming processes in production of a semiconductor device, such as a metal wiring, polysilicon film, epitaxial growth film, resistance film, metal plug and silicon nitride film.

According to the present invention, the following advantages can be obtained.

(1) Since polishing is carried out while forming a uniform surface layer of a polishing cloth, a uniform polishing rate can be maintained to thereby improve lot uniformity, and an equal quantity is removed from the surface of an object to be polished by polishing.

(2) Since polishing is carried out while recreating a surface shape of a polishing cloth to keep the surface shape uniformly, uniform pressure is always applied to an object to be polished. Therefore, an equal quantity can be removed from a surface of the object, for example an inter-layer insulating film, so that uniformity is improved. Also, irrespective of density of a wiring, the surface of the inter-layer insulating film can be polished to be flat in a micro view and to be a surface matching the surface of a wafer base in a macro view.

What is claimed is:

1. A flattening method of a semiconductor device by a chemical-mechanical polishing process comprising, preparing a synthetic resin polishing cloth in a circular form and a tool for forming a surface layer of the synthetic resin polishing cloth to have fluff thereon in a polishing process, said tool having an annular shape with a diameter less than a radial length of the polishing cloth, and rotating the polishing cloth along a central axis thereof and pressing the tool on a radial portion of the polishing cloth, said tool being moved along a radial direction of the polishing cloth and perpendicular to the radial direction to form the fluff on the polishing cloth so that the polishing cloth can evenly and continuously polish the semiconductor device.

2. A flattening method as claimed in claim 1, wherein said polishing process is one of an initial stage of the polishing process, a middle of the polishing process, continuously during the polishing process, and before termination of the polishing process.

3. A flattening method as claimed in claim 2, wherein said synthetic resin polishing cloth has a hardness higher than 80 measured by a c scale according to JIS-6301.

4. A flattening method as claimed in claim 3, wherein said hardness is from 90 to 110.

5. A flattening method as claimed in claim 1, wherein said fluff is formed on the polishing cloth continuously while polishing is being made by the polishing cloth, said fluff retaining abrasive particles therein for flattening the semiconductor device.

6. A flattening method of a semiconductor device by a chemical-mechanical polishing process comprising, preparing a synthetic resin polishing cloth in a circular form and a tool for forming a surface layer of the synthetic resin polishing cloth to have fluff thereon, said tool having an annular shape with a diameter less than a radial length of the polishing cloth, rotating the polishing cloth along a central axis thereof and pressing the tool on one radial portion of the polishing cloth, said tool being moved along a radial direction of the polishing cloth and perpendicular to the radial direction to form the fluff on the polishing cloth, and rotating means for supporting the semiconductor device along a central axis thereof and pressing the semiconductor device on a different radial portion of the polishing cloth to polish the semiconductor device while the tool is moved on the polishing cloth to recreate a surface shape thereof so that the polishing cloth can evenly and continuously polish the semiconductor device.

7. A flattening method as claimed in claim 6, wherein said fluff is formed on the polishing cloth continuously while polishing is being made by the polishing cloth, said fluff retaining abrasive particles therein for flattening the semiconductor device.

8. A flattening method as claimed in claim 6, wherein said polishing process is one of an initial stage of the polishing process, a middle of the polishing process, continuously during the polishing process, and before a termination of the polishing process.

9. A flattening method as claimed in claim 8, wherein said synthetic resin polishing cloth has a hardness of higher than 80 measured by a c scale according to JIS-6301.

10. A flattening method as claimed in claim 9, wherein said hardness is from 90 to 110.

11. A flattening apparatus of a semiconductor device by a chemical-mechanical polishing process comprising, a flattening device having a circular polishing cloth for polishing the semiconductor device, said flattening device being rotated in one direction along a central axis thereof, a device for forming a surface layer of the polishing cloth having fluff thereon, said forming device having an annular shape with a diameter less than a radial length of the polishing cloth, and a tool arm connected to the forming device, said tool arm being moved along a radial direction of the polishing cloth and perpendicular to the radial direction to form the fluff on the polishing cloth while polishing is being made by the polishing cloth.

12. A flattening apparatus as claimed in claim 11, wherein said device for forming the surface layer of the polishing cloth recreates a surface shape of the polishing cloth.

13. A flattening apparatus as claimed in claim 12, further comprising means for supporting the semiconductor device, said supporting means and said device for forming the surface layer being located adjacent to the polishing cloth of the flattening device.

14. A flattening apparatus of a semiconductor device by a chemical-mechanical polishing process comprising, a flattening device having a circular polishing cloth for polishing the semiconductor device, said flattening device being rotated in one direction along a central axis thereof, means for supporting the semiconductor device situated at a side facing the polishing cloth of the flattening device, said supporting means rotating along a central axis thereof and pressing the rotating semiconductor device on a radial portion of the polishing cloth, and a device for recreating a surface shape of the polishing cloth disposed adjacent to the supporting means to face the polishing cloth, said recreating device having an annular shape with a diameter less than a radial length of the polishing cloth, and a surface shape recreating face with a curvature in a radial direction thereof to which the semiconductor device slidingly contacts and being actuated while the semiconductor device is being polished by the flattening device to recreate the polishing cloth continuously.

15. A flattening apparatus as claimed in claim 14, wherein said recreating device forms a surface layer to have fluff thereon while recreating the surface shape of the polishing cloth.

16. A flattening apparatus as claimed in claim 15, wherein said recreating device is a tool including diamond abrasive grains.

17. A flattening apparatus as claimed in claim 15, wherein said surface shape recreating face of the recreating device includes diamond abrasive grains.

18. A flattening apparatus as claimed in claim 15, wherein said recreating device operating as the forming device is made of ceramic.

19. A flattening apparatus as claimed in claim 15, wherein said surface layer of the recreating device is made of ceramic.

20. A flattening apparatus as claimed in claim 19, wherein said surface layer made of ceramic is fixed with diamond.

21. A flattening apparatus as claimed in claim 19, wherein said surface layer of the recreating device includes a plurality of projections.

* * * * *